US011475851B2

(12) United States Patent
Kim et al.

(10) Patent No.: US 11,475,851 B2
(45) Date of Patent: Oct. 18, 2022

(54) PIXEL SENSING APPARATUS AND PANEL DRIVING APPARATUS

(71) Applicant: LX Semicon Co., Ltd., Daejeon (KR)

(72) Inventors: Seong Geon Kim, Daejeon (KR); Won Kim, Daejeon (KR); Young Bok Kim, Daejeon (KR)

(73) Assignee: LX Semicon Co., Ltd., Daejeon (KR)

( * ) Notice: Subject to any disclaimer, the term of this patent is extended or adjusted under 35 U.S.C. 154(b) by 0 days.

(21) Appl. No.: 17/527,127

(22) Filed: Nov. 15, 2021

(65) Prior Publication Data

US 2022/0157262 A1 May 19, 2022

(30) Foreign Application Priority Data

Nov. 19, 2020 (KR) ..... 10-2020-0155074

(51) Int. Cl.
*G09G 3/3291* (2016.01)
*G09G 3/3258* (2016.01)

(52) U.S. Cl.
CPC ..... *G09G 3/3291* (2013.01); *G09G 3/3258* (2013.01); *G09G 2310/0294* (2013.01)

(58) Field of Classification Search
CPC ..... G09G 2310/027; G09G 2310/0264; G09G 2320/0295; G09G 2320/0693; G09G 2320/045; G09G 2320/0233; G09G 3/006; G09G 3/3258; G09G 3/3291; G09G 3/3233; G09G 2300/0819; G09G 2330/12
See application file for complete search history.

(56) References Cited

U.S. PATENT DOCUMENTS

| | | | | |
|---|---|---|---|---|
| 9,692,996 | B2 | 6/2017 | Choi et al. | |
| 9,754,523 | B2 | 9/2017 | Lee et al. | |
| 10,297,192 | B2 | 5/2019 | Lee et al. | |
| 2002/0105449 | A1* | 8/2002 | Schreier | H03M 3/482 341/139 |
| 2011/0227864 | A1 | 9/2011 | Baek | |
| 2014/0368415 | A1* | 12/2014 | Kim | G09G 3/3208 345/77 |
| 2015/0116557 | A1 | 4/2015 | Choi et al. | |
| 2016/0133217 | A1 | 5/2016 | Lee et al. | |
| 2018/0096649 | A1* | 4/2018 | Lee | G09G 3/3291 |
| 2019/0356877 | A1 | 11/2019 | Eshel et al. | |
| 2020/0175921 | A1* | 6/2020 | Choi | G09G 3/3241 |

FOREIGN PATENT DOCUMENTS

| | | | |
|---|---|---|---|
| KR | 100991130 | B1 | 11/2010 |
| KR | 10-2015-0047934 | A | 5/2015 |
| KR | 10-2016-0056988 | A | 5/2016 |
| KR | 10-2018-0036200 | A | 4/2018 |

OTHER PUBLICATIONS

"AP32121—ADC Measurement and Specification", Nov. 2010, Infineon Technologies AG, V1.1 (Year: 2010).*

* cited by examiner

*Primary Examiner* — Dong Hui Liang
(74) *Attorney, Agent, or Firm* — Fenwick & West LLP

(57) ABSTRACT

The present embodiment relates to a technology for driving a display device, and provides a technology for adjusting the full-scale range (FSR) of an analog-to-digital converter according to a mode when sensing a pixel.

12 Claims, 7 Drawing Sheets

PIXEL SENSING APPARATUS AND PANEL DRIVING APPARATUS

CROSS REFERENCE TO RELATED APPLICATION

This application claims priority from Republic of Korea Patent Application No. 10-2020-0155074, filed on Nov. 19, 2020, which is hereby incorporated by reference in its entirety.

BACKGROUND

1. Field of Technology

The present embodiment relates to a technology for driving a display device.

2. Description of the Prior Art

A display device includes a source driver for driving pixels disposed on a panel.

The source driver determines a data voltage according to image data, and supplies the data voltage to pixels, thereby controlling the brightness of each pixel.

Meanwhile, even if the same data voltage is supplied, the brightness of each pixel may vary depending on the characteristics of the pixels. For example, a pixel includes a driving transistor, and if the threshold voltage of the driving transistor changes, the brightness of the pixel varies even if the same data voltage is supplied thereto. If the source driver fails to consider such changes in the characteristics of pixels, there may occur a problem in that the pixels, when driven, exhibit undesired brightness, and the image quality is degraded.

Specifically, characteristics of pixels change over time or depending on peripheral environments. If the source driver supplies a data voltage without considering changed characteristics of pixels, there occurs a problem of degraded image quality (for example, a blurry screen).

In order to alleviate such problematic degradation of image quality, a display device may include a pixel sensing device for sensing the characteristics of pixels.

The pixel sensing device may receive an analog signal regarding each pixel through a sensing line connected to each pixel. The pixel sensing device converts the analog signal into pixel sensing data and transmits the same to a timing controller, and the timing controller then identifies characteristics of respective pixels on the basis of the pixel sensing data. The timing controller compensates for image data by reflecting characteristics of respective pixels such that the problematic degradation of image quality resulting from deviations among the pixels can be alleviated.

The pixel sensing device may sense characteristics of pixels in a time section in which the panel is not driven. For example, the pixel sensing device may sense characteristics of pixels in a V-Blank section in which the panel is not driven within a single frame. In addition, the pixel sensing device may sense characteristics of pixels in a state in which panel driving is stopped after a system-related off signal is received.

However, the influence of noise may become heavier in connection with pixel characteristic sensing because the latter time section is relatively longer, and the former time section is relatively shorter. Heavy noise influence causes errors in sensing values, and the compensation process may adversely increase pixel deviations. This may cause a problem of degraded image quality.

SUMMARY OF THE INVENTION

In this background, it is an aspect of the present embodiment to provide a technology for sensing characteristics of pixels while minimizing the influence of noise. It is another aspect of the present embodiment to provide a technology for reducing the influence of noise when sensing pixel characteristics during a relative short time section. It is another aspect of the present embodiment to provide a technology for improving the accuracy of sensing when sensing pixel characteristics during a relative long time section. It is another aspect of the present embodiment to provide a technology for adjusting the influence of noise and the accuracy of sensing according to the length of a sensing section.

In an aspect, the present embodiment provides a pixel sensing device for sensing characteristics of a pixel disposed on a display panel, the pixel sensing device including: an analog circuit configured to obtain a characteristic voltage of the pixel; an analog-to-digital converter configured to convert the characteristic voltage into digital data and change a full-scale range (FSR) according to a mode; and a digital processing circuit configured to generate pixel sensing data according to the digital data.

The FSR voltage may comprise a positive FSR voltage and a negative FSR voltage. The control circuit may select and output one positive FSR voltage among a plurality of positive FSR voltages according to the control signal for the mode, and may select and output one negative FSR voltage among a plurality of negative FSR voltages.

In the first mode, the sensing section may be formed within the V-Blank section of one frame, and in the second mode, the sensing section may be formed after the off signal of the system.

In another aspect, the present embodiment provides a device for driving a panel on which a pixel is disposed, and a data line and a sensing line connected to the pixel are disposed, the panel driving device including: a data driving circuit configured to convert image data into a data voltage and supply the data voltage to the data line; a data processing circuit configured to compensate for the image data using pixel sensing data corresponding to characteristics of the pixel; and a pixel sensing circuit including an analog circuit configured to obtain a characteristic voltage of the pixel and an analog-to-digital converter configured to convert the characteristic voltage into digital data and to vary a full-scale range (FSR) according to a mode, the pixel sensing circuit being configured to generate pixel sensing data according to the digital data.

The pixel sensing circuit may sense the pixel within a V-Blank section of one frame in a first mode and may sense the pixel after an off signal of a system in a second mode.

As described above, according to the present embodiment, pixel characteristics can be sensed while minimizing the influence of noise. In addition, according to the present embodiment, the influence of noise can be reduced when sensing pixel characteristics during a relative short time section. In addition, according to the present embodiment, the accuracy of sensing can be improved when sensing pixel characteristics during a relative long time section. In addition, according to the present embodiment, the influence of noise and the accuracy of sensing can be adjusted according to the length of a sensing section.

DETAILED DESCRIPTION OF THE EXEMPLARY EMBODIMENTS

Figure 1:
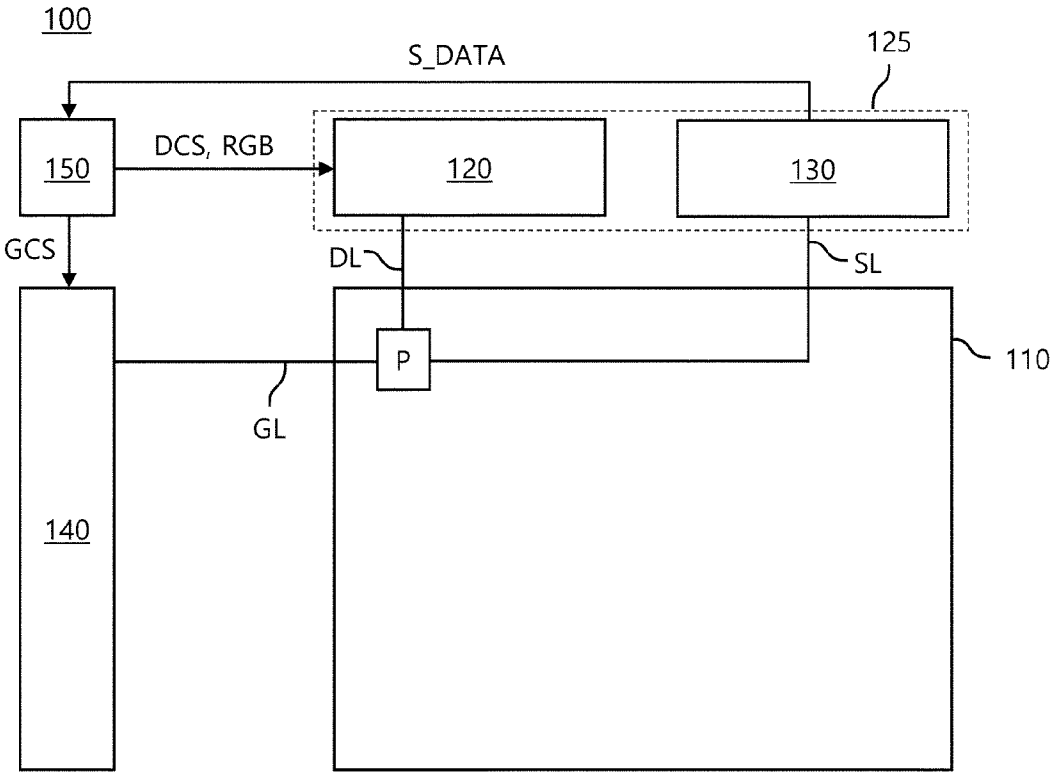
FIG. 1 is a configuration diagram of a display device according to an embodiment.

FIG. 1 is a configuration diagram of a display device according to an embodiment.

Referring to FIG. 1, the display device 100 may include a panel 110 and a panel driving devices 120, 130, 140, and 150 that drive the panel 110.

A plurality of data lines DL, a plurality of gate lines GL, and a plurality of sensing lines SL may be disposed on the panel 110, and a plurality of pixels P may be disposed on the panel 110.

The devices 120, 130, 140, and 150 that drive at least one component included in the panel 110 may be referred to as panel driving devices. For example, the data driving circuit 120, the pixel sensing circuit 130, the gate driving circuit 140, the data processing circuit 150 may be referred to as panel driving devices.

Each of the above-described circuits 120, 130, 140, and 150 may be referred to as a panel driving device, and all or a plurality of circuits may be referred to as panel driving devices.

In the panel driving devices, the gate driving circuit 140 may supply a scan signal of a turn-on voltage or turn-off voltage to the gate line GL. When a scan signal of the turn-on voltage is supplied to the pixel P, the pixel P is connected to the data line DL, and when a scan signal of the turn-off voltage is supplied to the pixel P, the connection between the pixel P and the data line DL is released.

In the panel driving devices, the data driving circuit 120 supplies a data voltage to the data line DL. The data voltage supplied to the data line DL is transmitted to the pixel P connected to the data line DL according to the scan signal.

In the panel driving devices, the pixel sensing circuit 130 receives an analog signal generated in each pixel P, for example, a voltage, a current, or the like. The pixel sensing circuit 130 may be connected to each pixel P according to a scan signal, or may be connected to each pixel P according to a separate sensing signal. In this case, the separate sensing signal may be generated by the gate driving circuit 140.

In the panel driving devices, the data processing circuit 150 may supply various control signals to the gate driving circuit 140 and the data driving circuit 120. The data processing circuit 150 may generate a gate control signal GCS for starting a scan according to a timing implemented in each frame and transmit the generated gate control signal GCS to the gate driving circuit 140. The data processing circuit 150 may output, to the data driving circuit 120, image data RGB obtained by converting image data input from the outside according to a data signal format used by the data driving circuit 120. The data processing circuit 150 may transmit a data control signal DCS for controlling the data driving circuit 120 to supply a data voltage to each pixel P according to each timing.

The data processing circuit 150 may compensate and transmit the image data RGB according to the characteristics of the pixel P. In this case, the data processing circuit 150 may receive pixel sensing data S_DATA from the pixel sensing circuit 130. The pixel sensing data S_DATA may include a measurement value for the characteristic of the pixel P.

The data driving circuit 120 may be referred to as a source driver. The gate driving circuit 140 may be referred to as a gate driver. The data processing circuit 150 may be referred to as a timing controller. The data driving circuit 120 and the pixel sensing circuit 130 may be included in a single integrated circuit 125 and may be referred to as a source driver integrated circuit (IC). The data driving circuit 120, the pixel sensing circuit 130, and the data processing circuit 150 may be included in a single integrated circuit and may be referred to as a unified IC. Although the embodiment is not limited to these names, the description of some of the components generally known in the source driver, the gate driver, and the timing controller will be omitted in the description of the embodiment below. Therefore, in understanding the embodiments, it should be considered that some of these configurations are omitted.

The panel 110 may be an organic light emitting display panel. In this case, the pixels P arranged on the panel 110 may include an organic light emitting diode (OLED) and one or more transistors. The characteristics of the organic light emitting diode (OLED) and transistors included in each pixel P may change according to time or the surrounding environment. The pixel sensing circuit 130 according to an embodiment may sense the characteristics of these components included in each pixel P and transmit the sensed characteristics to the data processing circuit 150.

Figure 2:
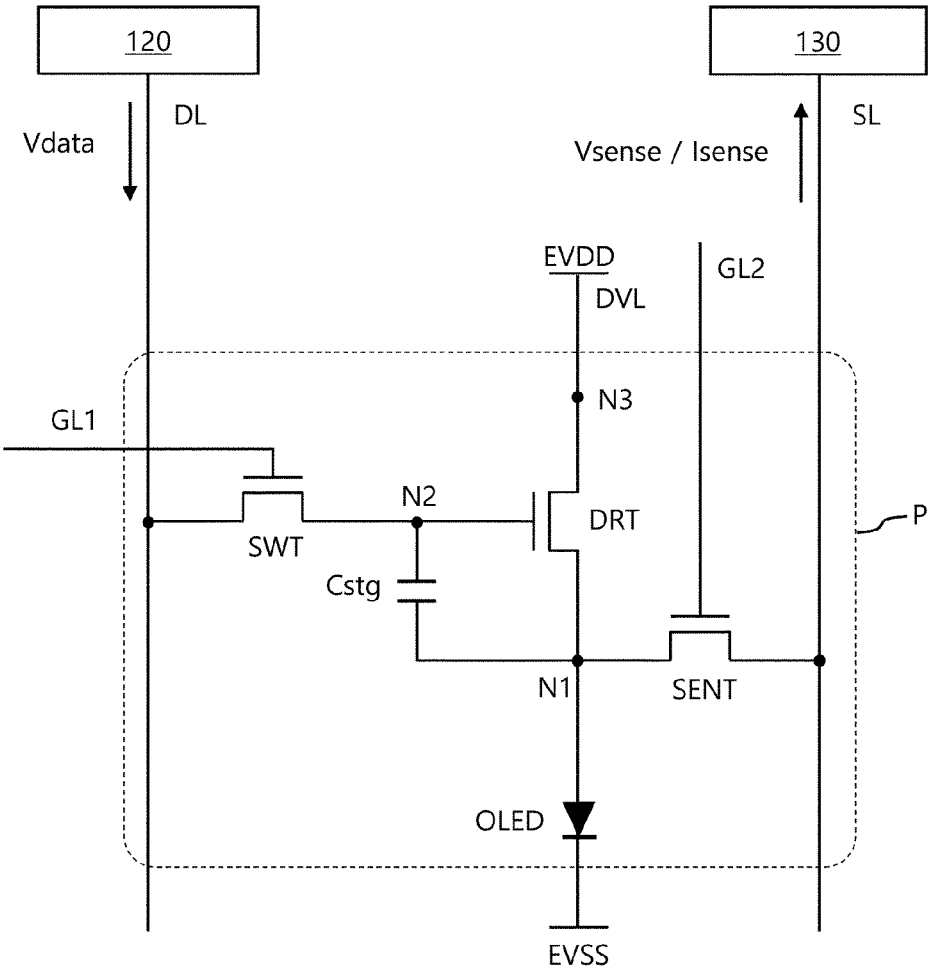
FIG. 2 is a diagram illustrating a structure of each pixel of FIG. 1 and signals input/output from/to a data driving circuit and a pixel sensing circuit from/to a pixel.

FIG. 2 is a diagram illustrating a structure of each pixel of FIG. 1 and signals input/output from/to a data driving circuit and a pixel sensing circuit from/to a pixel.

Referring to FIG. 2, the pixel P may include an organic light emitting diode (OLED), a driving transistor DRT, a switching transistor SWT, a sensing transistor SENT, a storage capacitor Cstg, or the like.

The organic light emitting diode (OLED) may include an anode electrode, an organic layer, and a cathode electrode. Under the control of the driving transistor DRT, the anode electrode is connected to a driving voltage EVDD and the cathode electrode is connected to a base voltage EVSS to emit light.

The driving transistor DRT may control the brightness of the organic light emitting diode (OLED) by controlling the driving current supplied to the organic light emitting diode (OLED).

A first node N1 of the driving transistor DRT may be electrically connected to the anode electrode of the organic light emitting diode (OLED) and may be a source node or a drain node. A second mode N2 of the driving transistor DRT may be electrically connected to a source node or a drain node of the switching transistor SWT and may be a gate node. A third node N3 of the driving transistor DRT may be electrically connected to a driving voltage line DVL supplying the driving voltage EVDD and may be a drain node or a source node The switching transistor SWT may be electrically connected between the data line DL and the second node N2 of the driving transistor DRT and may be turned on by receiving a scan signal through the gate lines GL1 and GL2.

When the switching transistor SWT is turned on, the data voltage Vdata supplied from the data driving circuit 120 through the data line DL is transmitted to the second node N2 of the driving transistor DRT.

The storage capacitor Cstg may be electrically connected between the first node N1 and the second node N2 of the driving transistor DRT.

The storage capacitor Cstg may be a parasitic capacitor existing between the first node N1 and the second node N2 of the driving transistor DRT and may be an external capacitor intentionally designed outside the driving transistor DRT.

The sensing transistor SENT may connect the first node N1 of the driving transistor DRT and the sensing line SL, and the sensing line SL may transfer a reference voltage Vref to the first node N1 and may transfer an analog signal, for example, a voltage or a current to the pixel sensing circuit 130.

The pixel sensing circuit 130 measures the characteristics of the pixels P by using an analog signal (Vsense or Isense) transmitted through the sensing line SL.

When the voltage of the first node N1 is measured, the threshold voltage, current mobility, current characteristic, etc. of the driving transistor DRT can be determined. In addition, when the voltage of the first node N1 is measured, the degree of deterioration of the organic light emitting diode (OLED) such as parasitic capacitance and current characteristics of the organic light emitting diode (OLED) can be determined.

The pixel sensing circuit 130 may measure the voltage of the first node N1 and transmit the measured value to the data processing circuit (refer to 150 in FIG. 1). In addition, the data processing circuit (refer to 150 in FIG. 1) may determine the characteristic of each pixel P by analyzing the voltage of the first node N1.

Meanwhile, the pixel sensing circuit 130 may sense the characteristic of a pixel in a time section in which the panel is not driven. For example, the pixel sensing circuit 130 may sense the characteristic of the pixel in a V-Blank section in which the panel is not driven in one frame. The pixel sensing circuit 130 may sense the characteristic of the pixel in a time section after driving of the panel is stopped according to an off signal for the system, that is, a system including the display device.

Figure 3:
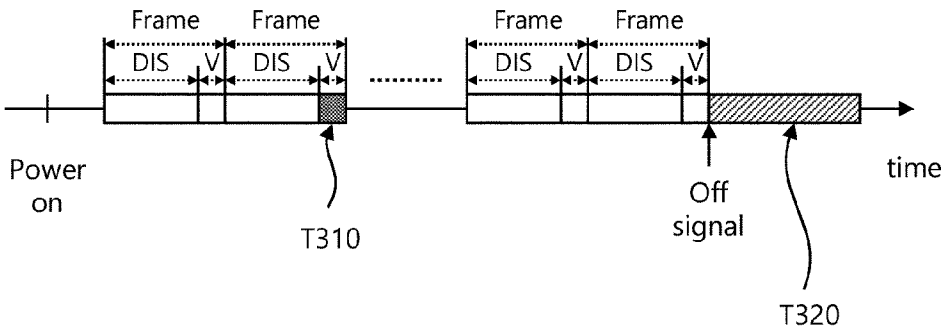
FIG. 3 is a diagram illustrating a sensing section of a pixel sensing circuit according to an embodiment.

FIG. 3 is a diagram illustrating sensing sections of a pixel sensing circuit according to an embodiment.

Referring to FIG. 3, the sensing sections T310 and T320 in which the pixel sensing circuit senses a pixel may be formed in a V-Blank section and a section after the off signal.

One frame may be divided into a display section DIS for updating an image and the V-Blank section V. The image may not be updated in the V-Blank section V. The first sensing section T310 in which the pixel sensing circuit senses the pixel may be formed in the V-Blank section. The V-Blank section may have a relatively short length. When a plurality of first sensing sections for a plurality of pixels are formed within the V-Blank section, each of the first sensing section may have a length of several tens of us.

Since the length of the section is relatively short, the pixel sensing circuit may sense the current mobility of the driving transistor in the pixel in the first sensing section T310. The pixel sensing circuit may sense a characteristic voltage related to the current mobility of the pixel while supplying a relatively high current to the pixel for a short time.

After the off signal, an image may not be displayed on the panel. The second sensing section T320 in which the pixel sensing circuit senses a pixel may be formed in a section after the off signal. The section after the off signal may have a relatively long length. When a plurality of second sensing periods for a plurality of pixels are formed within a period after the off signal, each second sensing period may have a length of several tens of ms.

Since the length of the section is relatively long, the pixel sensing circuit can sense the threshold voltage of the driving transistor in the pixel in the second sensing section T320. The pixel sensing circuit may sense a characteristic voltage related to a threshold voltage of the pixel while supplying a relatively low current to the pixel for a long time. Alternatively, the pixel sensing circuit may sense a characteristic voltage related to a threshold voltage of a pixel after waiting until a time point at or near a time point at which the driving transistor in the pixel is turned off. At the time of sampling, the current flowing to the driving transistor may be close to zero.

A mode of pixel sensing performed in the first sensing period may be referred to as a first mode, and a mode of pixel sensing performed in the second sensing period may be referred to as a second mode. The length of the sensing section in the first mode may be shorter than the length of the sensing section in the second mode.

The pixel sensing circuit may sense a characteristic voltage related to the current mobility of the driving transistor disposed in the pixel in the first mode, and may sense a characteristic voltage related to a threshold voltage of a driving transistor disposed in the pixel in the second mode. When comparing based on the sampling point, the amount of current supplied to the pixel in the first mode may be larger than the amount of current supplied to the pixel in the second mode.

The data processing device may compensate for the current mobility of the driving transistor disposed in the pixel according to the pixel sensing data generated in the first mode, and may compensate for the threshold voltage of the driving transistor disposed in the pixel according to the pixel sensing data generated in the second mode.

In the first mode, since pixels are sensed using a relatively large current in a relatively short sensing period, relatively larger noise may occur in the first mode. Since the second mode has a relatively long sensing period and senses pixels in a period in which the characteristic voltage is substantially saturated, that is, a period in which little current flows, relatively small noise may occur in the second mode.

Figure 4:
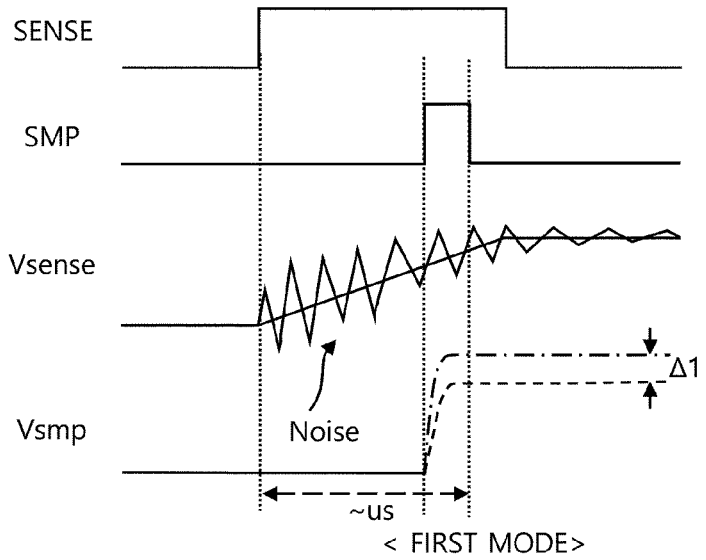
FIG. 4 is a diagram illustrating the magnitude of noise generated in a first mode and a second mode.
Figure 4:
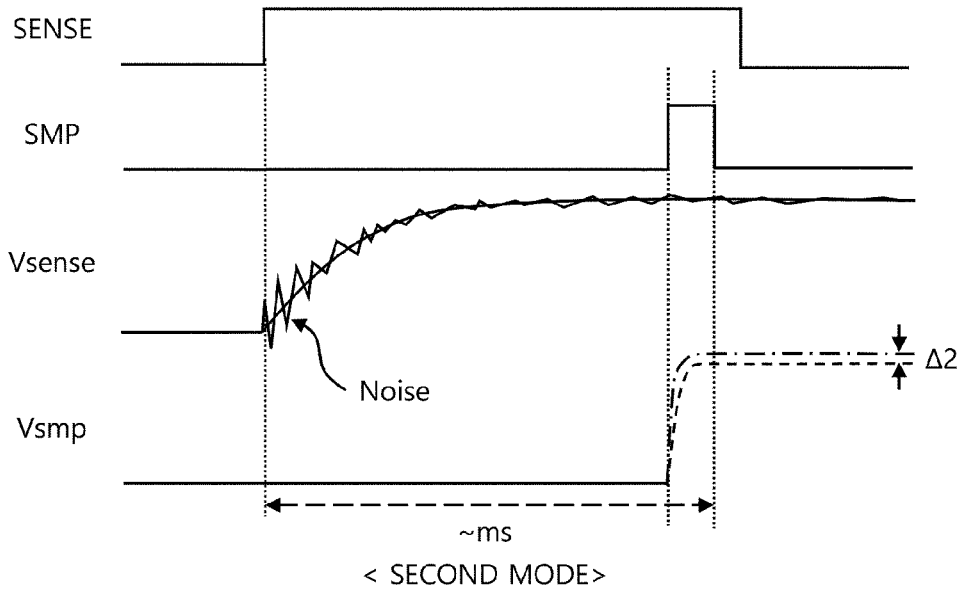

FIG. 4 is a diagram illustrating the magnitude of noise generated in the first mode and the second mode.

Referring to FIG. 4, when the sensing signal SENSE is converted to a high voltage level in the first mode, a current for sensing is supplied to the pixel and the sensing voltage Vsense of the pixel increases. In addition, the pixel sensing circuit may obtain the sampling voltage Vsmp by sampling the sensing voltage Vsense near the end of the first sensing section in which the sensing signal SENSE has a high voltage level. Here, the sampling voltage Vsmp may correspond to the characteristic voltage of the pixel. The display device may compensate for the current mobility of the driving transistor disposed in the pixel by using this characteristic voltage.

When the sensing signal SENSE is converted to a high voltage level in the second mode, a current for sensing is supplied to the pixel and the sensing voltage Vsense of the pixel increases. In addition, the pixel sensing circuit may obtain the sampling voltage Vsmp by sampling the sensing voltage Vsense near the end of the second sensing section in which the sensing signal SENSE has a high voltage level. Here, the sampling voltage Vsmp may correspond to the characteristic voltage of the pixel. The display device may compensate for the threshold voltage of the driving transistor disposed in the pixel by using this characteristic voltage.

In the first mode, the first sensing section may have a length of about several tens of us, and in the second mode, the second sensing section may have a length of about several tens of ms. In each mode, sampling is performed in the second half of the sensing section. In the first mode, the length from the start point of the first sensing section to the sampling section can have a length of about several tens of us, and in the second mode, and the length from the start point of the second sensing section to the sampling section may have a length of about several tens of ms.

The first mode may have a greater effect of noise due to a relatively short sensing period and a relatively large current compared to the second mode. Accordingly, the sensing error 41 due to noise in the first mode may appear larger than the sensing error 42 in the second mode. Such a sensing error may cause image quality deterioration. For example, horizontal or vertical stripes may be observed in an image due to such a sensing error.

In order to improve this problem, the pixel sensing circuit may increase the FSR of the analog-to-digital converter in a mode where a lot of noise occurs, and change the FSR so as to reduce the FSR of the analog-to-digital converter in a mode where there is less noise.

Figure 5:
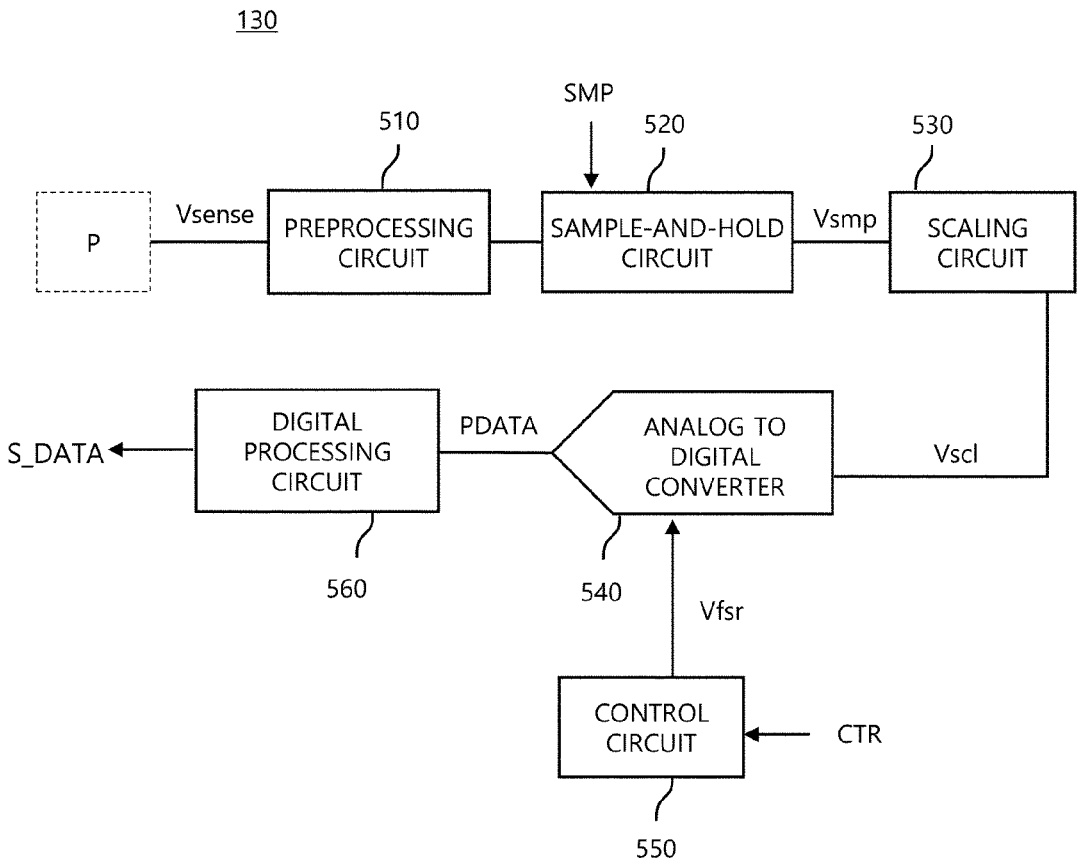
FIG. 5 is a configuration diagram of a pixel sensing circuit according to an embodiment.

FIG. 5 is a configuration diagram of a pixel sensing circuit according to an embodiment.

Referring to FIG. 5, the pixel sensing circuit 130 may include a preprocessing circuit 510, a sample-and-hold circuit 520, a scaling circuit 530, an analog-to-digital converter 540, a control circuit 550, a digital processing circuit 560, and the like.

When the preprocessing circuit 510 is connected to the pixel P, the preprocessing circuit 510 may receive the sensing voltage Vsense formed at one node of the pixel P. Alternatively, when the preprocessing circuit 510 is connected to the pixel P, the preprocessing circuit 510 may receive a sensing current flowing to one node of the pixel P.

The preprocessing circuit 510 may pre-process the sensing voltage Vsense. According to an exemplary embodiment, only the wiring may be disposed in the preprocessing circuit 510 without other circuit elements.

The sample-and-hold circuit 520 may sample the sensing voltage Vsense and hold the sampling voltage Vsmp. The sample-and-hold circuit 520 may include a sampling switch and a hold capacitor. When the sampling switch is closed, the sensing voltage Vsense is transmitted to the hold capacitor, so that the sensing voltage Vsense may be sampled and held. The sampling switch may be closed by the sampling signal SMP, and the sampling signal SMP may occur in the second half of the sensing section.

The scaling circuit 530 may adjust the scale of the sampling voltage Vsmp. The scaling circuit 530 may include a scaling capacitor and may adjust the scale of the sampling voltage by using charge sharing between the hold capacitor and the scaling capacitor. The scaling voltage Vscl output from the scaling circuit 530 may correspond to the characteristic voltage of the pixel. In addition, the characteristic voltage of such a pixel may be converted into digital data PDATA by the analog-to-digital converter 540.

Circuits before the analog-to-digital converter 540 may be classified as analog circuits. In the pixel sensing circuit 130, the analog circuit may include a preprocessing circuit 510, a sample-and-hold circuit 520, a scaling circuit 530, and the like, and may be mainly responsible for processing an analog signal. The analog circuit may sense the pixel P during the sensing period in which the pixel P and the preprocessing circuit 510 are connected to obtain a sensing voltage Vsense, and may sample the sensing voltage Vsense in some of the sampling periods to obtain a characteristic voltage, for example, a scaling voltage Vscl.

The digital data PDATA generated by the analog-to-digital converter 540 may be transferred to the digital processing circuit 560, and the digital processing circuit 560 may generate pixel sensing data S_DATA according to the digital data PDATA and transmit the generated pixel sensing data S_DATA to an externally disposed data processing circuit.

The control circuit 550 may supply the FSR voltage Vfsr to the analog-to-digital converter 540 according to the control signal CTR to change the full-scale range (FSR) of the analog-to-digital converter 540.

The control circuit 550 may change the FSR of the analog-to-digital converter 540 according to the mode, for example, when the lengths of the sensing section of the first mode and the sensing section of the second mode are different from each other, the control circuit 550 may set the FSR of the analog-to-digital converter 540 differently in the first mode and the second mode.

As an example, the control circuit 550 may set the FSR of the mode in which the length of the sensing section is short is greater than that of the mode in which the length of the sensing section is long. As another example, the control circuit 550 may set the FSR larger as the length from the start point of the sensing section to the sampling section is shorter.

The analog-to-digital converter 540 may be relatively less affected by noise when the FSR increases. However, depending on the embodiment, if the FSR increases, the linearity of the analog-to-digital conversion may decrease, resulting in loss of accuracy. Accordingly, the analog-to-digital converter 540 may increase the FSR in a noisy environment and decrease the FSR in a low-noise environment.

The FSR of the analog-to-digital converter 540 may be determined according to the supplied FSR voltage, and the control circuit 550 may vary the FSR of the analog-to-digital converter 540 by varying the FSR voltage.

The FSR voltage may include a negative FSR voltage corresponding to the lower voltage of the FSR and a positive FSR voltage corresponding to the upper voltage. The control circuit 550 may vary the FSR of the analog-to-digital converter 540 by varying the negative FSR voltage and the positive FSR voltage.

Figure 6:
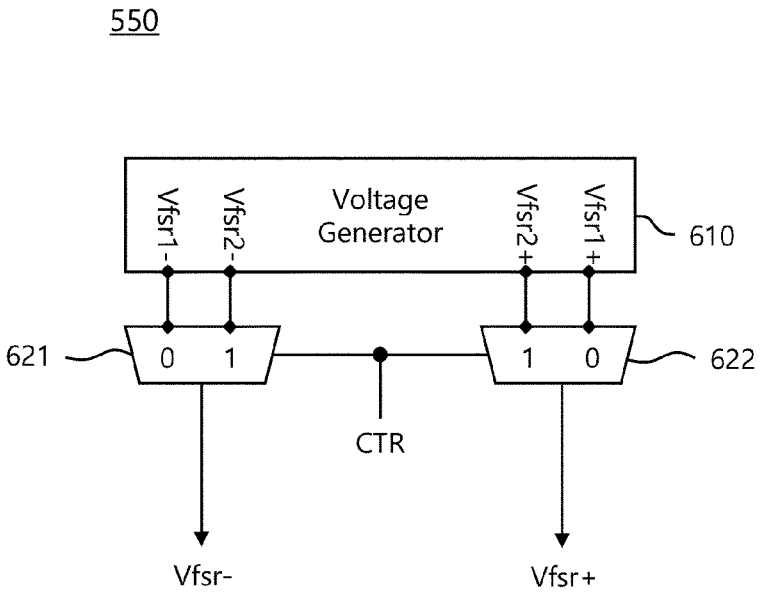
FIG. 6 is a configuration diagram of a control circuit in a pixel sensing circuit according to an embodiment.

FIG. 6 is a configuration diagram of a control circuit in a pixel sensing circuit according to an embodiment; and Referring to FIG. 6, the control circuit 550 may include a voltage generator 610 and a plurality of selectors 621 and 622.

The voltage generator 610 may generate a plurality of positive FSR voltages Vfsr1+ and Vfsr2+, and may generate a plurality of negative FSR voltages Vfsr1− and Vfsr2−. The voltage generator 610 may output a plurality of negative FSR voltages Vfsr1− and Vfsr2− to the first selector 621, and may transfer a plurality of positive FSR voltages Vfsr1+ and Vfsr2+ to the second selector 622.

The first selector 621 may output one of the plurality of negative FSR voltages Vfsr1− and Vfsr2− as the negative FSR voltage Vfsr− according to the control signal CTR.

In addition, the second selector 622 may output one of the plurality of positive FSR voltages Vfsr1+ and Vfsr2+ as the positive FSR voltage Vfsr+ according to the control signal CTR.

The first cathode FSR voltage Vfsr1− may be a voltage lower than the second cathode FSR voltage Vfsr2−, and the first anode FSR voltage Vfsr1+ may be a voltage higher than the second anode FSR voltage Vfsr2+. The control circuit 550 may select and output the first negative FSR voltage Vfsr1− and the first positive FSR voltage Vfsr1+ according to the control signal for the first mode (CTR having a value of 0), and may select and output the second negative FSR voltage Vfsr2− and the second positive FSR voltage Vfsr2+ according to the control signal for the second mode (CTR having a value of 1).

Figure 7:
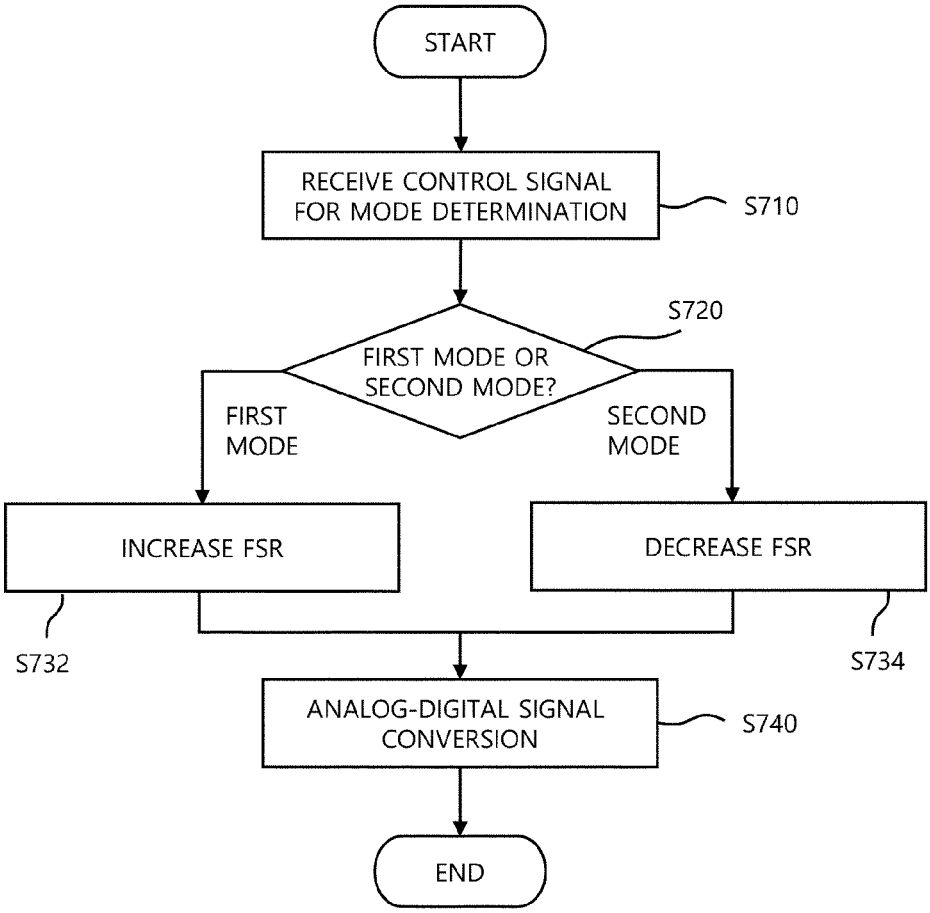
FIG. 7 is a flowchart of an FSR control method for each mode of a pixel sensing circuit according to an embodiment.

FIG. 7 is a flowchart of an FSR control method for each mode of a pixel sensing circuit according to an embodiment.

Referring to FIG. 7, the pixel sensing circuit may receive a control signal for mode determination (S710). The pixel sensing circuit may receive a control signal from a data processing circuit or a control signal from a data driving circuit. The data processing circuit or the data driving circuit can recognize the V-Blank section according to the display timing in the panel driving device and generate a control signal for mode determination. The data processing circuit may receive an off signal from an external device, for example, a host device, and generate a control signal for mode determination according to the off signal.

The pixel sensing circuit may determine whether the mode is a first mode or a second mode according to the control signal (S720).

When the mode is the first mode, the pixel sensing circuit may increase the FSR of the analog-to-digital converter (S732), and when the mode is the second mode, the pixel sensing circuit may decrease the FSR of the analog-to-digital converter (S734).

The pixel sensing circuit can convert the characteristic voltage of the pixel into digital data using an analog-to-digital converter according to the changed FSR.

As described above, according to the present embodiment, pixel characteristics can be sensed while minimizing the influence of noise. In addition, according to the present embodiment, the influence of noise can be reduced when sensing pixel characteristics during a relative short time section. In addition, according to the present embodiment, the accuracy of sensing can be improved when sensing pixel characteristics during a relative long time section. In addition, according to the present embodiment, the influence of noise and the accuracy of sensing can be adjusted according to the length of a sensing section.

What is claimed is:

1. A pixel sensing device comprising:

an analog circuit configured to obtain a characteristic voltage of a pixel disposed in a display panel;

an analog-to-digital converter configured to convert the characteristic voltage into digital data and change a full-scale range (FSR) according to a mode; and a digital processing circuit configured to generate pixel sensing data according to the digital data, wherein the analog circuit senses the pixel to obtain a sensing voltage for a sensing section, and samples the sensing voltage in some sampling sections of the sensing section to obtain the characteristic voltage, and wherein the FSR is set larger as the length from the start of the sensing section to the sampling section is shorter.

2. The pixel sensing device of claim 1, wherein the lengths of the sensing section of a first mode and the sensing section of a second mode are different from each other, and wherein the analog-to-digital converter sets the FSR differently in the first mode and the second mode.

3. The pixel sensing device of claim 2, wherein the FSR of the mode in which the length of the sensing section is short is set to be larger than the FSR in the mode in which the length of the sensing section is long.

4. The pixel sensing device of claim 1, wherein the FSR of the analog-to-digital converter is determined according to the supplied FSR voltage, and the pixel sensing device further comprises a control circuit configured to vary the FSR voltage according to the mode.

5. The pixel sensing device of claim 4, wherein the FSR voltage comprises a positive FSR voltage and a negative FSR voltage, and wherein the control circuit selects and outputs one positive FSR voltage among a plurality of positive FSR voltages according to the control signal for the mode, and selects and outputs one negative FSR voltage among a plurality of negative FSR voltages.

6. The pixel sensing device of claim 1, wherein the analog circuit comprises a sample-and-hold circuit configured to obtain a characteristic voltage of the pixel, and a scaling circuit configured to adjust a scale of the characteristic voltage, and wherein the analog-to-digital converter converts the scale-adjusted characteristic voltage into the digital data.

7. A panel driving device comprising:

a data driving circuit configured to convert image data into a data voltage and supply the data voltage to a data line connected with a pixel;

a data processing circuit configured to compensate for the image data using pixel sensing data corresponding to characteristics of the pixel; and a pixel sensing circuit comprising an analog circuit configured to obtain a characteristic voltage of the pixel and an analog-to-digital converter configured to convert the characteristic voltage into digital data and to vary a full-scale range (FSR) according to a mode, the pixel sensing circuit being configured to generate the pixel sensing data according to the digital data, wherein the pixel sensing circuit senses the pixel within a V-Blank section of one frame in a first mode, and senses the pixel after an off signal of a system in a second mode.

8. The panel driving device of claim 7, wherein the pixel sensing circuit receives a control signal for the mode from the data processing circuit or the data driving circuit.

9. The panel driving device of claim 7, wherein the data processing circuit compensates for the current mobility of a driving transistor disposed in the pixel according to the pixel sensing data generated in the first mode, and compensates for the threshold voltage of the driving transistor according to the pixel sensing data generated in the second mode.

10. The panel driving device of claim 7, wherein the pixel sensing circuit increases the FSR in the first mode than in the second mode.

11. The panel driving device of claim 7, wherein a higher current is supplied to the pixel in the first mode than in the second mode at a sampling time.

12. A pixel sensing device comprising:

an analog circuit configured to obtain a characteristic voltage of a pixel disposed in a display panel;

an analog-to-digital converter configured to convert the characteristic voltage into digital data and change a full-scale range (FSR) according to a mode; and a digital processing circuit configured to generate pixel sensing data according to the digital data, wherein the analog circuit senses the pixel within a V-Blank section of one frame in a first mode, and senses the pixel after an off signal of a system in a second mode.

* * * * *